US008854172B2

(12) United States Patent
Choi et al.

(10) Patent No.: US 8,854,172 B2
(45) Date of Patent: Oct. 7, 2014

(54) INDUCTOR AND TRANSFORMER

(75) Inventors: Young Deok Choi, Seoul (KR); Sun Mi Jung, Hwaseong-si (KR); Tae Sung Kim, Suwon-si (KR); Hyo Soon Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 13/300,166

(22) Filed: Nov. 18, 2011

(65) Prior Publication Data

US 2012/0126925 A1 May 24, 2012

(30) Foreign Application Priority Data

Nov. 22, 2010 (KR) ..... 10-2010-0116181

(51) Int. Cl.

| | |
|---|---|
| ***H01F 27/30*** | (2006.01) |
| ***H01F 27/28*** | (2006.01) |
| ***H01F 17/04*** | (2006.01) |
| ***H01F 27/26*** | (2006.01) |

(52) U.S. Cl.

CPC ..... *H01F 27/303* (2013.01); *H01F 27/306* (2013.01); *H01F 27/263* (2013.01)

USPC ..... 336/198; 336/170; 336/182; 336/184; 336/220; 336/221

(58) Field of Classification Search

USPC ..... 336/170, 182, 184, 198, 220, 221

See application file for complete search history.

(56) References Cited

U.S. PATENT DOCUMENTS

| | | | | |
|---|---|---|---|---|
| 5,594,402 | A * | 1/1997 | Krichtafovitch et al. | 336/65 |
| 6,344,786 | B1 * | 2/2002 | Chin | 336/198 |
| 6,927,650 | B2 * | 8/2005 | Okamoto | 333/181 |
| 6,927,660 | B2 * | 8/2005 | Okamoto | 336/192 |
| 7,772,957 | B2 * | 8/2010 | Chen et al. | 336/208 |
| 8,013,710 | B2 * | 9/2011 | Lai et al. | 336/212 |
| 2008/0169769 | A1 * | 7/2008 | Lee | 315/278 |

* cited by examiner

*Primary Examiner* — Alexander Talpalatski
*Assistant Examiner* — Kazi Hossain
(74) *Attorney, Agent, or Firm* — Sughrue Mion, PLLC

(57) ABSTRACT

An inductor and a transformer, each of which includes a first bobbin on which a first coil is wound and a second bobbin on which a second coil is wound, are provided. The first bobbin includes a first bobbin part on which the first coil is wound and a first support part provided at one end of the first bobbin part. The second bobbin includes a second bobbin part on which the second coil is wound and a second support part provided at one end of the second bobbin part. Another end of the first bobbin part is coupled to the second support part and another end of the second bobbin part is coupled to the first support part.

18 Claims, 5 Drawing Sheets

INDUCTOR AND TRANSFORMER

CROSS-REFERENCE TO RELATED APPLICATION

This application claims priority from Korean Patent Application No. 10-2010-0116181, filed on Nov. 22, 2010 in the Korean Intellectual Property Office, the disclosure of which is incorporated herein by reference.

BACKGROUND

1. Field

Apparatuses consistent with exemplary embodiments relate to an inductor and a transformer.

2. Description of the Related Art

An inductor serves to induce voltage in proportion to current change. The inductor may include a coil, a bobbin on which the coil is wound, and a core arranged inside the bobbin to guide magnetic flux generated by the coil.

A transformer may be configured by arranging a pair of inductors having the above-described configuration in parallel such that the coils wound on the two inductors have different numbers of turns.

SUMMARY

Exemplary embodiments provide an inductor and a transformer, which may be simply mass produced.

In accordance with an aspect of an exemplary embodiment, there is provided an inductor which includes a first bobbin on which a first coil is wound, and a second bobbin on which a second coil is wound, the first bobbin includes at least one first bobbin part on which the first coil is wound and a first support part provided at one end of the at least one first bobbin part, the second bobbin includes at least one second bobbin part on which the second coil is wound and a second support part provided at one end of the at least one second bobbin part, and one end of the first bobbin part is coupled to the second support part and one end of the second bobbin part is coupled to the first support part.

The inductor may further include a core having a plurality of core parts arranged within the first bobbin part and the second bobbin part.

The core may include a first core having a plurality of first partial core parts, which penetrates the first support part and extends within the first bobbin part and the second bobbin part, and a second core having a plurality of second partial core parts, which penetrates the second support part and extends within the first bobbin part and the second bobbin part so as to come into contact with the first partial core parts within the first bobbin part and the second bobbin part.

The core may further include at least one intermediate core part extending between the first bobbin part and the second bobbin part.

The intermediate core part may include a first intermediate core part extending from the first core through the first support part and a second intermediate core part extending from the second core through the second support part, the first and second intermediate core parts being arranged to face each other.

In accordance with another aspect of an exemplary embodiment, there is provide a transformer which includes a first bobbin, on which a first coil and a third coil having different numbers of turns are wound to form a first transformer, a second bobbin, on which a second coil and a fourth coil having different numbers of turns are wound to form a second transformer, the first bobbin includes at least one first bobbin part on which the first coil and the third coil are wound, and a first support part provided at one end of the at least one first bobbin part, the second bobbin includes at least one second bobbin part on which the second coil and the fourth coil are wound, and a second support part provided at one end of the at least one second bobbin part, and the other end of the first bobbin part is coupled to the second support part and the other end of the second bobbin part is coupled to the first support part.

The transformer may further include a core having a plurality of core parts arranged within the first bobbin part and the second bobbin part and an intermediate core part extending between the first bobbin part and the second bobbin part. The intermediate core part may have a cross sectional area twice that of the partial core part.

The transformer may further include an insulating layer arranged between the first coil and the third coil and between the second coil and the fourth coil.

BRIEF DESCRIPTION OF THE DRAWINGS

These and/or other aspects will become apparent and more readily appreciated from the following description of the exemplary embodiments, taken in conjunction with the accompanying drawings of which.

DETAILED DESCRIPTION

Figure 1:
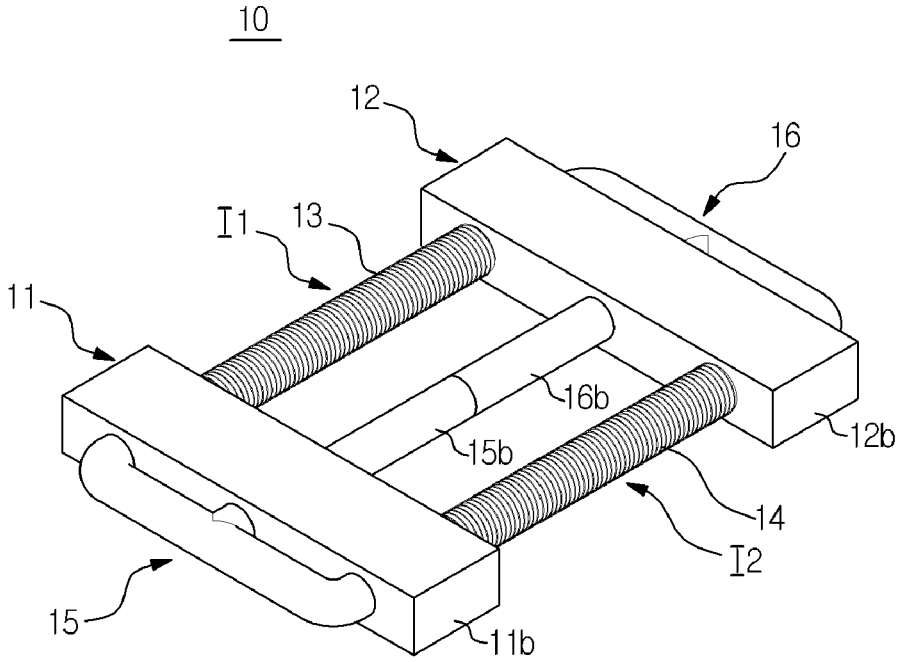
FIG. 1 is a perspective view of an inductor in accordance with an exemplary embodiment.

Reference will now be made in detail to an inductor and a transformer in accordance with the exemplary embodiments, examples of which are illustrated in the accompanying drawings, wherein like reference numerals refer to like elements throughout.

Figure 2:
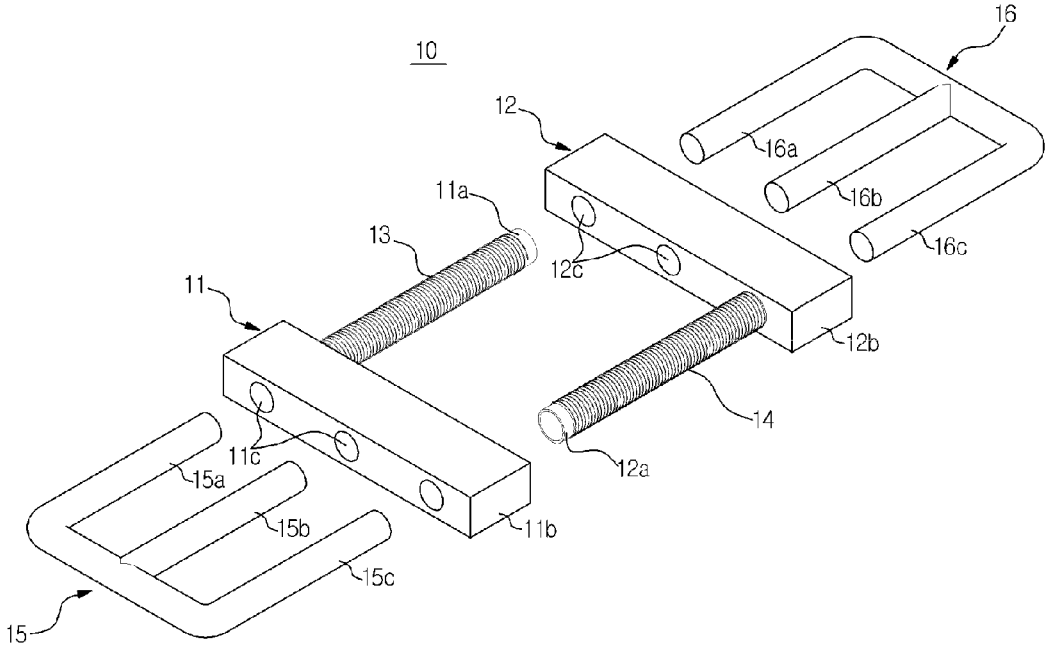
FIG. 2 is an exploded perspective view of the inductor in accordance with an exemplary embodiment.

As illustrated in FIGS. 1 and 2, an inductor 10 in accordance with an exemplary embodiment includes a first bobbin 11 provided with a first coil 13 and a second bobbin 12 provided with a second coil 14.

The first bobbin 11 includes a first bobbin part 11*a* on which the first coil 13 is wound, and a first support part 11*b* provided at one end of the first bobbin part 11*a* to support one end of the first coil 13. The second bobbin 12 includes a second bobbin part 12*a* on which the second coil 14 is wound, and a second support part 12*b* provided at one end of the second bobbin part 12*a* to support one end of the second coil 14.

The other end of the first bobbin part 11*a* is coupled to the second support part 12*b* and the other end of the second bobbin part 12*a* is coupled to the first support part 11*b*. As such, the first bobbin part 11*a* on which the first coil 13 is wound forms a first inductor I1 and the second bobbin part 12*a* on which the second coil 14 is wound forms a second inductor I2.

With the above-described integral formation of the first inductor I1 and the second inductor I2, the first support part 11*b* supports both one end of the first coil 13 wound on the first bobbin part 11*a* and one end of the second coil 14 wound on the second bobbin part 12*a*. Also, the second support part 12*b* supports both the other end of the second coil 14 wound on the second bobbin part 12*a* and the other end of the first coil 13 wound on the first bobbin part 11*a*.

Accordingly, each of the first bobbin 11 and the second bobbin 12 is provided with the single support part 11*b* or 12*b* without requiring two support parts, and first bobbin 11 and the second bobbin 12 are coupled to each other to hold the support parts 11*b* and 12*b* in common. As such, both ends of the first and second coils 13 and 14 wound respectively on the first and second bobbin parts 11*a* and 12*a* may be supported respectively by the first support part 11*b* and the second support part 12*b*.

The inductor 10 further includes first and second cores 15 and 16 to guide magnetic flux generated by the coils 13 and 14.

The first core 15 includes first partial core parts 15*a* and 15*c*, which penetrate the first support part 11*b* and are located respectively in a partial region of the first bobbin part 11*a* and a partial region of the second bobbin part 12*a*. The second core 16 includes second partial core parts 16*a* and 16*c*, which penetrate the second support part 12*b* and are located in the remaining region of the first bobbin part 11*a* and the remaining region of the second bobbin part 12*a*. Facing ends of the first partial core parts 15*a* and 15*c* and the second partial core parts 16*a* and 16*c* are connected to each other within the first bobbin part 11*a* and the second bobbin part 12*a* to enable conduction of magnetic flux.

The first core 15 further includes a first intermediate core part 15*b* which extends from the first core 15 through the first support part 11*b* and is located between the first bobbin part 11*a* and the second bobbin part 12*a*. The second core 16 further includes a second intermediate core part 16*b* which extends from the second core 16 through the second support part 12*b* and is located between the first bobbin part 11*a* and the second bobbin part 12*a*. The first intermediate core part 15*b* and the second intermediate core part 16*b* are arranged to face each other.

The first support part 11*b* and the second support part 12*b* are respectively provided with a plurality of through-holes 11*c* and 12*c* which are penetrated by the above-described core parts 15*a*, 15*c*, 16*a* and 16*c* and intermediate core parts 15*b* and 16*b*. The first and second cores 15 and 16 include the pairs of partial core parts 15*a* and 16*a* and the single intermediate core parts 15*b* and 16*b* and thus, the first support part 11*b* and the second support part 12*b* are respectively provided with three through-holes 11*c* and 12*c*.

Figure 3:
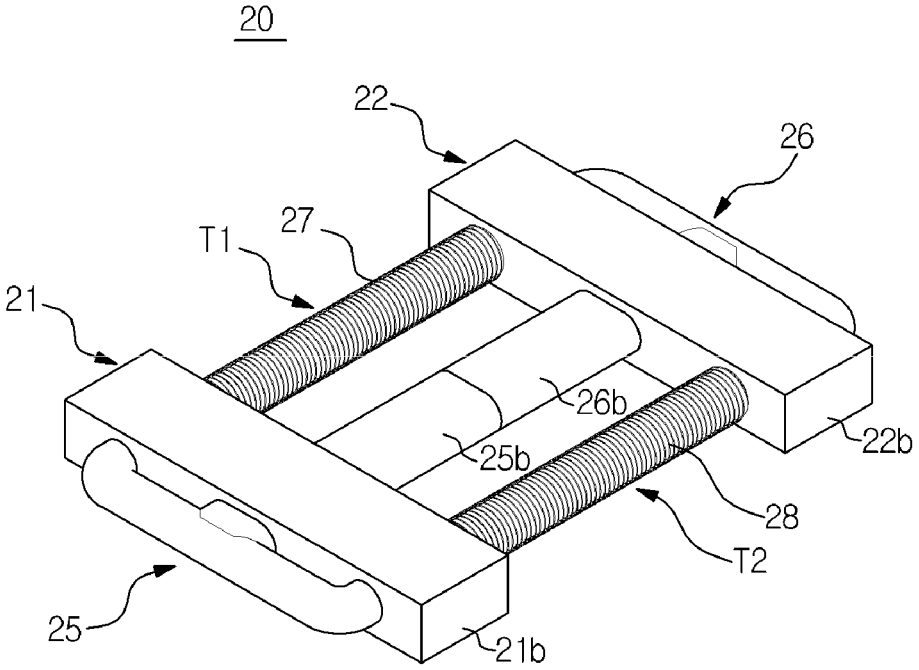
FIG. 3 is a perspective view of a transformer in accordance with an exemplary embodiment.
Figure 4:
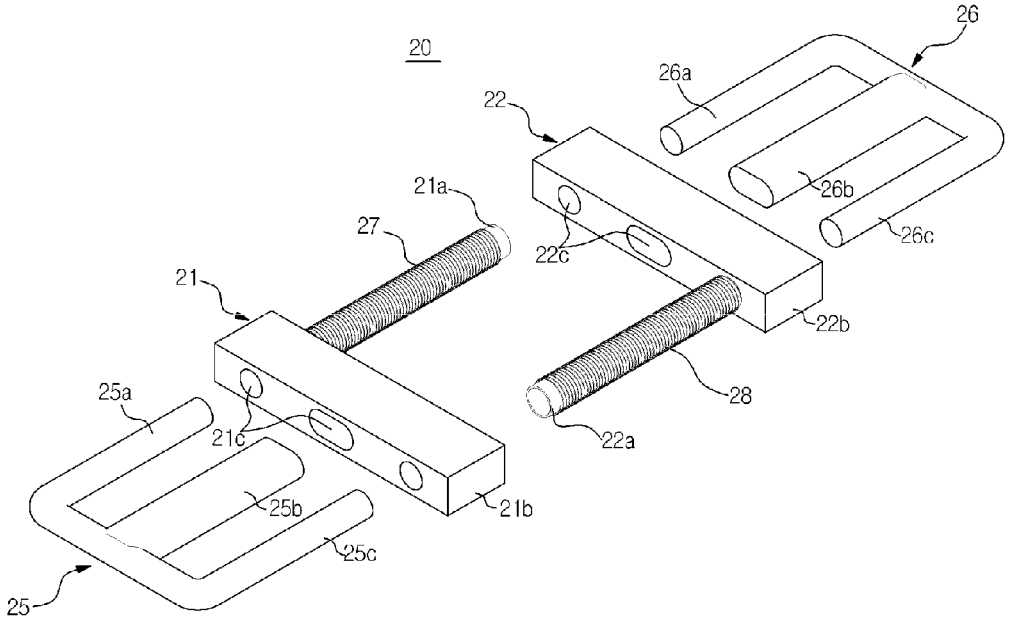
FIG. 4 is an exploded perspective view of the transformer in accordance with an exemplary embodiment.
Figure 5:
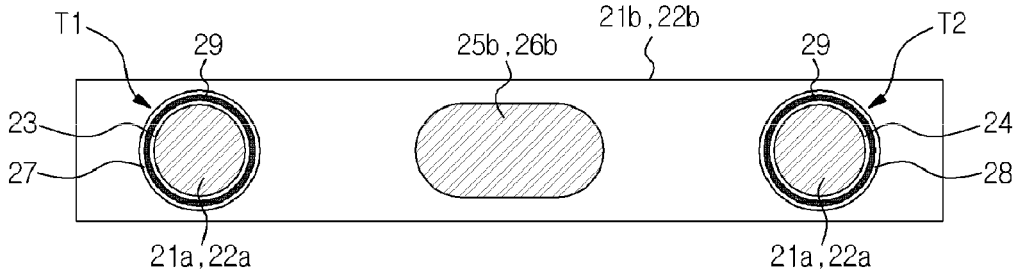
FIG. 5 is a sectional view of the transformer in accordance with an exemplary embodiment.

FIGS. 3, 4 and 5 illustrate a transformer 20 in accordance with an exemplary embodiment.

As illustrated, a first bobbin 21 includes a single first support part 21*b* and a single first bobbin part 21*a* and a second bobbin 22 includes a single second support part 22*b* and a single second bobbin part 22*a*.

As illustrated in FIG. 5, the first bobbin part 21*a* is provided with a pair of first and third coils 23 and 27 having different numbers of turns, and the second bobbin part 22*a* is provided a pair of second and fourth coils 24 and 28 having different numbers of turns. After the coils 23, 24, 27 and 28 are wound on the respective bobbin parts 21*a* and 22*a*, one end of the first bobbin part 21*a* is inserted into a through-hole 22*c* of the second support part 22*b* and one end of the second bobbin part 22*a* is inserted into a through-hole 21*c* of the first support part 21*b*. In this way, a first transformer T1 and a second transformer T2 are formed.

More specifically, the first coil 23 and the third coil 27, which have different numbers of turns, are wound on the first bobbin part 21*a* of the first bobbin 21 to form the first transformer T1. Also, the second coil 24 and the fourth coil 28, which have different numbers of turns, are wound on the second bobbin part 22*a* of the second bobbin 22 to form the second transformer T2. In this case, an insulating layer 29 made of an insulating film is provided between the first coil 23 and the third coil 27 and between the second coil 24 and the fourth coil 28.

The transformer 20, as illustrated in FIGS. 3 and 4, includes first and second cores 25 and 26 to guide magnetic flux generated by the coils 23, 24, 27 and 28. The first core 25 includes first core parts 25*a* and 25*c* which penetrate the first support part 21*b* and are located respectively in a partial region of the first bobbin part 21*a* and a partial region of the second bobbin part 22*a*. The second core 26 includes second core parts 26*a* and 26*c* which penetrate the second support part 22*b* and are located in the remaining region of the first bobbin part 21*a* and the remaining region of the second bobbin part 22*a*.

The cores 25 and 26 further include first and second intermediate core parts 25*b* and 26*b*, respectively, extending between the first bobbin part 21 and the second bobbin part 22*a* to guide magnetic flux. The first intermediate core part 25*b* extends from the first core 25 through the first support part 21*b* and is located between the first bobbin part 21*a* and the second bobbin part 22*a*. The second intermediate core part 26*b* extends from the second core 26 through the second support part 22*b* and is located between the first bobbin part 21*a* and the second bobbin part 22*a*. The first intermediate core part 25*b* and the second intermediate core part 26*b* are arranged to face each other.

The intermediate core parts 25*b* and 26*b* may have a cross sectional area twice that of the first core parts 25*a* and 25*c* and the second core parts 26*a* and 26*c*, to enable simultaneous conduction of magnetic flux generated by the first transformer T1 and the second transformer T2.

The first and second bobbins 11 and 12 of the inductor 10 and the first and second bobbins 21 and 22 of the transformer 20, as described above, hold the first and second support parts 11*b* and 12*b* and 21*b* and 22*b* in common, which reduces the number of constituent elements required to manufacture two inductors 10 and two transformers 20.

In addition, in the first and second bobbins 11 and 12 of the inductor 10 and the first and second bobbins 21 and 22 of the transformer 20, the support part 11*b*, 12*b*, 21*b* or 22*b* is provided only at one end of the bobbin part 11*a*, 12*a*, 21*a* or 22*a*, which allows the coils 13, 14, 23, 24, 27 and 28 to be more easily wound from the other end of the bobbin part 11*a*, 12*a*, 21*a* or 22*a*.

Although the inductor 10 and transformer 20 in accordance with the above-described exemplary embodiments have been described as the first bobbin 11 or 21 including the single bobbin part 11*a* or 21*a* and the second bobbin 12 or 22 including the single second bobbin part 12*a* or 22*a*, the exemplary embodiments are not limited thereto. Alternatively, the first bobbin and the second bobbin may be respectively provided with a plurality of first bobbin parts or second bobbin parts such that a plurality of inductors or transformers may be simultaneously formed by the two bobbins.

According to the exemplary embodiments, a plurality of inductors or transformers may be obtained using two support parts, which significantly reduces the number of constituent elements required to form two inductors or two transformers.

Further, each bobbin is configured in such a way that the support part is provided only at one end of each bobbin part, which facilitates easy winding of a coil from the other end of the bobbin part at which the support part is not provided.

Although a few exemplary embodiments have been shown and described, it would be appreciated by those skilled in the art that changes may be made in these exemplary embodiments without departing from the principles and spirit of the inventive concept, the scope of which is defined in the claims and their equivalents.

What is claimed is:

1. An inductor comprising:

a first coil;

a second coil;

a first bobbin on which the first coil is wound; and a second bobbin on which the second coil is wound, wherein the first bobbin includes a first single bobbin part on which the first coil is wound and a first single support part provided at a first end of the first single bobbin part, wherein the second bobbin includes a second single bobbin part on which the second coil is wound and a second single support part provided at a first end of the second single bobbin part, and wherein a second end of the first single bobbin part is coupled to the second single support part of the second bobbin and a second end of the second single bobbin part is coupled to the first single support part of the first bobbin.

2. The inductor according to claim 1, further comprising a core including a plurality of core parts arranged within the first single bobbin part and the second single bobbin part.

3. The inductor according to claim 2, wherein the core further includes at least one intermediate core part extending between the first single bobbin part and the second single bobbin part through a hole in the first single support part and a hole in the second single support part.

4. The inductor according to claim 1, further comprising a first core and a second core, wherein the first core includes a plurality of first partial core parts which penetrate through holes in the first single support part and extend within the first single bobbin part and the second single bobbin part, and wherein the second core includes a plurality of second partial core parts which penetrate through holes in the second single support part and extend within the first single bobbin part and the second single bobbin part so as to come into contact with the first partial core parts within the first bobbin part and the second bobbin part.

5. The inductor according to claim 4, wherein the first core further includes a first intermediate core part extending from the first core through a hole in the first single support part, the second core further includes a second intermediate core part extending from the second core through a hole in the second single support part, and the first and second intermediate core parts are arranged to face each other.

6. A transformer comprising:

a first coil;

a second coil;

a third coil having a number of turns that is different than a number of turns of the first coil;

a fourth coil having a number of turns that is different than a number of turns of the second coil;

a first bobbin on which the first coil and the third coil are wound; and a second bobbin on which the second coil and the fourth coil are wound, wherein the first bobbin includes a first single bobbin part on which the first coil and the third coil are wound, and a first single support part provided at a first end of the first single bobbin part, wherein the second bobbin includes a second single bobbin part on which the second coil and the fourth coil are wound, and a second single support part provided at a first end of the second single bobbin part, and wherein a second end of the first single bobbin part is coupled to the second single support part of the second bobbin and a second end of the second single bobbin part is coupled to the first single support part of the first bobbin.

7. The transformer according to claim 6, further comprising a core including a plurality of core parts arranged within the first single bobbin part and the second single bobbin part.

8. The transformer according to claim 7, wherein the core further includes at least one intermediate core part extending between the first single bobbin part and the second single bobbin part through a hole in the first single support part and a hole in the second single support part.

9. The transformer according to claim 8, wherein the intermediate core part has a cross sectional area which two times a cross sectional area of the core parts, and wherein the support part have through holes with different sizes.

10. The transformer according to claim 6, further comprising a first core and a second core, wherein the first core includes a plurality of first partial core parts which penetrate the first single support part and extend within the first single bobbin part and the second single bobbin part, and wherein the second core includes a plurality of second partial core parts which penetrate the second single support part and extend within the first single bobbin part and the second single bobbin part so as to come into contact with the first core parts within the first single bobbin part and the second single bobbin part.

11. The transformer according to claim 9, wherein the first core includes a first intermediate core part extending through the first single support part, wherein the second core further includes a second intermediate core part extending through the second single support part, and wherein the first and second intermediate core parts are arranged to face each other.

12. The transformer according to claim 6, further comprising:

a first insulating layer interposed between the first coil and the third coil; and a second insulating layer interposed between the second coil and the fourth coil.

13. An inductor comprising:

a first coil;

a second coil;

a first bobbin which includes a first single support part and a first single bobbin part which extends from the first single support part;

a second bobbin which includes a second single support part and a second single bobbin part which extends from the second single support part;

wherein the first coil is wound on the first single bobbin part to form a first inductor, the second coil is wound on the second single bobbin part to form a second inductor, the first single bobbin part is coupled to the second single support part of the second bobbin, and the second single bobbin part is coupled to the first single support part of the first bobbin.

14. The inductor according to claim 13, wherein the first single bobbin includes a plurality of through holes and the second single bobbin includes a plurality of through holes, the inductor further comprising:

a first core which extends through the through holes of the first single support part and extends within the first single bobbin part and the second single bobbin part; and a second core which extends through the through holes of the second single support part and extends within the first single bobbin part and the second single bobbin part.

15. The inductor according to claim 14, wherein the first core includes a first partial core part which extends through one the through holes of the first single support part and extends within the first single bobbin part, and a second partial core part which extends through another one the through holes of the first single support part and extends within the second single bobbin part, and wherein the second core includes a first partial core part which extends through one the through holes of the second single support part and extends within the first single bobbin part so as to come into contact with the first partial core part of the first core within the first single bobbin part, and a second partial core part which extends through another one the through holes of the second single support part and extends within the second single bobbin part so as to come into contact with the second partial core part of the first core within the second single bobbin part.

16. A transformer comprising:

a first coil;

a second coil;

a third coil having a number of turns that is different than a number of turns of the first coil;

a fourth coil having a number of turns that is different than a number of turns of the second coil;

a first bobbin including a first single support part and a first single bobbin part which extends from the first single support part; and a second bobbin including a second single support part and a second single bobbin part which extends from the second single support part, wherein the first coil and the third coil are wound on the first bobbin to form a first transformer, the second coil and the fourth coil are wound on the second bobbin to form a second transformer, the first single bobbin part is coupled to the second single support part of the second bobbin, and the second single bobbin part is coupled to the first single support part of the first bobbin.

17. The transformer according to claim 16, wherein the first bobbin includes a plurality of through holes and the second bobbin includes a plurality of through holes, the transformer further comprising:

a first core which extends through the through holes of the first single support part and extends within the first single bobbin part and the second single bobbin part; and a second core which extends through the through holes of the second single support part and extends within the first single bobbin part and the second single bobbin part.

18. The transformer according to claim 17, wherein the first core includes a first partial core part which extends through one the through holes of the first single support part and extends within the first single bobbin part, and a second partial core part which extends through another one the through holes of the first single support part and extends within the second single bobbin part, and wherein the second core includes a first partial core part which extends through one the through holes of the second single support part and extends within the first single bobbin part so as to come into contact with the first partial core part of the first core within the first single bobbin part, and a second partial core part which extends through another one the through holes of the second single support part and extends within the second single bobbin part so as to come into contact with the second partial core part of the first core within the second single bobbin part.

* * * * *